US011519693B2

(12) United States Patent
Huang et al.

(10) Patent No.: US 11,519,693 B2
(45) Date of Patent: Dec. 6, 2022

(54) GUN LAMP ON A GUN

(71) Applicant: Nextorch Industries Co., Ltd., Guangdong (CN)

(72) Inventors: Jinjie Huang, Guangdong (CN); Bing Liang, Guangdong (CN)

(73) Assignee: Nextorch Industries Co., Ltd., Yangjiang (CN)

( * ) Notice: Subject to any disclaimer, the term of this patent is extended or adjusted under 35 U.S.C. 154(b) by 0 days.

(21) Appl. No.: 17/536,084

(22) Filed: Nov. 28, 2021

(65) Prior Publication Data

US 2022/0205759 A1 Jun. 30, 2022

(30) Foreign Application Priority Data

Dec. 30, 2020 (CN) ..... 202023329028.X
Feb. 25, 2021 (CN) ..... 202120419250.4

(51) Int. Cl.
*F41G 1/35* (2006.01)
*F41G 11/00* (2006.01)

(52) U.S. Cl.
CPC ..... *F41G 1/35* (2013.01); *F41G 11/001* (2013.01)

(58) Field of Classification Search
CPC ..... F41G 11/001; F41G 11/003
See application file for complete search history.

(56) References Cited

U.S. PATENT DOCUMENTS 9,841,258 B1 * 12/2017 Galli ..... F41G 11/003
2011/0067287 A1 * 3/2011 Collin ..... F41G 11/003 42/90
2021/0140743 A1 * 5/2021 Chen ..... F41G 11/003

* cited by examiner

*Primary Examiner* — Karabi Guharay
(74) *Attorney, Agent, or Firm* — Gang Yu

(57) ABSTRACT

A lamp is provided. The lamp may include: a housing, a guide rail clamp, arranged on the housing, the guide rail clamp including a first sliding block and a second sliding block that are arranged at intervals, the first sliding block being detachably arranged on the housing, a connecting component, the connecting component being in connection with the first sliding block to fix the first sliding block on the housing, the connecting component forming an assembling unit jointly with the first sliding block, a positioning structure, including a positioning piece and a positioning hole, the positioning piece being arranged on one of the housing and the assembling unit, the positioning hole being arranged on another of the housing and the assembling unit, and the positioning piece being inserted into the positioning hole when the assembling unit moves to an assembling position.

20 Claims, 6 Drawing Sheets

GUN LAMP ON A GUN

CROSS-REFERENCE TO RELATED APPLICATION

The disclosure claims priority to Chinese Patent Applications No. 202023329028.X and 202120419250.4, filed to the China National Intellectual Property Administration on Dec. 30, 2020 and Feb. 25, 2021 and entitled "Lamp", the disclosures of which are hereby incorporated by reference in their entirety.

TECHNICAL FIELD

The disclosure relates to a technical field of police equipment, and in particular to a lamp.

BACKGROUND

At present, through arranging a gun lamp on a gun, the gun lamp may be used to assist illumination. The gun is provided with a guide rail, the gun lamp is provided with a guide rail clamp, and the gun lamp may be assembled onto the gun by making use of cooperation of the guide rail and the guide rail clamp.

In the related art, in the process of assembling the gun lamp onto the gun, there are too many operations, and the assembling process is complicated, and it is inconvenient to assemble.

SUMMARY

The disclosure provides a lamp, as to solve the problem that it is inconvenient to assemble a lamp in the related art.

The disclosure provides a lamp. The lamp may include: a housing, a guide rail clamp, arranged on the housing, the guide rail clamp including a first sliding block and a second sliding block that are arranged at intervals, the first sliding block being detachably arranged on the housing, a connecting component, the connecting component being in connection with the first sliding block to fix the first sliding block on the housing, the connecting component and the first sliding block jointly forming an assembling unit, a positioning structure, including a positioning piece and a positioning hole, the positioning piece being arranged on one of the housing and the assembling unit, the positioning hole being arranged on another of the housing and the assembling unit, and the positioning piece being inserted into the positioning hole when the assembling unit moves to an assembling position.

In some embodiments, the housing has a mounting channel, the connecting component includes a connecting part, the connecting part is moveably penetrated in the mounting channel, the positioning piece is arranged on one of a channel wall of the mounting channel and the connecting part, and the positioning hole is arranged on another of the channel wall of the mounting channel and the connecting part.

In some embodiments, the positioning piece is made from an elastic material.

In some embodiments, the connecting part has an accommodating hole, an end of the positioning piece is positioned inside the accommodating hole, and another end of the positioning piece is arranged corresponding to the positioning hole.

In some embodiments, the connecting part includes a connecting piece and a locking piece, a first end of the connecting piece is in connection with the first sliding block, the second sliding block has an avoiding hole that is arranged corresponding to the mounting channel, the locking piece is positioned on a side, far away from the connecting piece, of the second sliding block, and the locking piece passes through the avoiding hole and is in connection with a second end of the connecting piece.

In some embodiments, the locking piece includes a first section and a second section connected with the first section. The first section is positioned on the side, far away from the connecting piece, of the second sliding block, an outer diameter of the first section is greater than an outer diameter of the second section and a diameter of the avoiding hole, and the second section passes through the avoiding hole and is in connection with the second end of the connecting piece by a screw.

In some embodiments, the mounting channel is a mounting groove, the positioning hole is arranged at a bottom of the mounting groove, and the positioning piece is arranged on a side wall of the connecting part.

In some embodiments, the lamp further includes a limiting structure, the limiting structure including a limiting column and a first limiting groove, the limiting column being arranged on one of the housing and the first sliding block, the first limiting groove being arranged on another of the housing and the first sliding block, the limiting column being moveably inserted into the first limiting groove, and an extension direction of the first limiting groove is the same as an extension direction of the mounting channel.

In some embodiments, the housing has two mounting channels that are arranged at intervals, the limiting column is arranged on the housing and positioned between the two mounting channels, and two sides of the first sliding block are symmetrically provided with two first limiting grooves.

In some embodiments, the housing has multiple mounting channels that are arranged at intervals, and/or, the mounting channel extends along a width direction of the housing, and both the first sliding block and the second sliding block extend along a length direction of the housing.

In some embodiments, the housing has a notch, and the first sliding block is arranged in the notch.

In some embodiments, the positioning piece is arranged on one of the housing and the first sliding block, the positioning hole is arranged on another of the housing and the first sliding block, the connecting component includes a connection locking piece, and the connection locking piece is in connection with the first sliding block, so as to lock the first sliding block on the housing.

In some embodiments, the housing has a limiting boss, a side wall of the first sliding block is provided with a second limiting groove, an extension direction of the second limiting groove is parallel to an assembling direction of the first sliding block, and the limiting boss fits the second limiting groove in a limiting manner.

In some embodiments, a side wall of the housing is provided with a notch, the notch has a side opening and a top opening, the limiting boss is positioned at the top opening of the notch, and a lower part of the first sliding block is positioned inside the notch.

In some embodiments, the positioning piece or the positioning hole is positioned on a bottom wall of the notch.

In some embodiments, each of two sides of the top opening of the notch is provided with one limiting boss, each of two sides of the first sliding block is provided with one second limiting groove, and two limiting bosses correspond to two second limiting grooves one by one.

In some embodiments, the positioning hole includes a first positioning hole and a second positioning hole, and the first positioning hole and the second positioning hole are arranged at intervals along the assembling direction of the first sliding block.

In some embodiments, when the first sliding block is positioned at the assembling position, the positioning piece is inserted into the first positioning hole, and a side, far away from the first positioning hole, of the second positioning hole has an avoiding opening.

In some embodiments, the first sliding block has a screw hole, a first end of the connection locking piece has an external screw, and a second end of the connection locking piece has a screwing part, the second sliding block has a through hole, the screwing part is positioned on a side, far away from the first sliding block, of the second sliding block, an outer diameter of the screwing part is greater than a diameter of the through hole, and a first end of the connection locking piece passes through the through hole and is in connection with the screw hole.

In some embodiments, an outer wall of the positioning piece has a curved surface.

With adoption of the technical solutions of the disclosure, the lamp includes the housing, the guide rail clamp, the connecting component and the positioning structure. The guide rail clamp includes the first sliding block and the second sliding block that are arranged at intervals. The first sliding block is fixed on the housing by making use of the connecting component, and the connecting component and the first sliding block jointly forms the assembling unit. In a process of fixing the first sliding block on the housing by making use of the connecting component, in presence of the cooperation of the positioning piece and the positioning hole of the positioning structure, the positioning piece is inserted into the positioning hole when the assembling unit moves to the assembling position, in this way the assembling unit is assembled and positioned, subsequent operations are facilitated, and accordingly an assembling process is simplified, and assembling is facilitated.

BRIEF DESCRIPTION OF THE DRAWINGS

The accompanying drawings described herein are used to provide a further understanding of the disclosure, and constitute a part of the present disclosure, and the exemplary embodiments of the disclosure and the description thereof are used to explain the disclosure, but do not constitute improper limitations to the disclosure. In the drawings.

Figure 1:
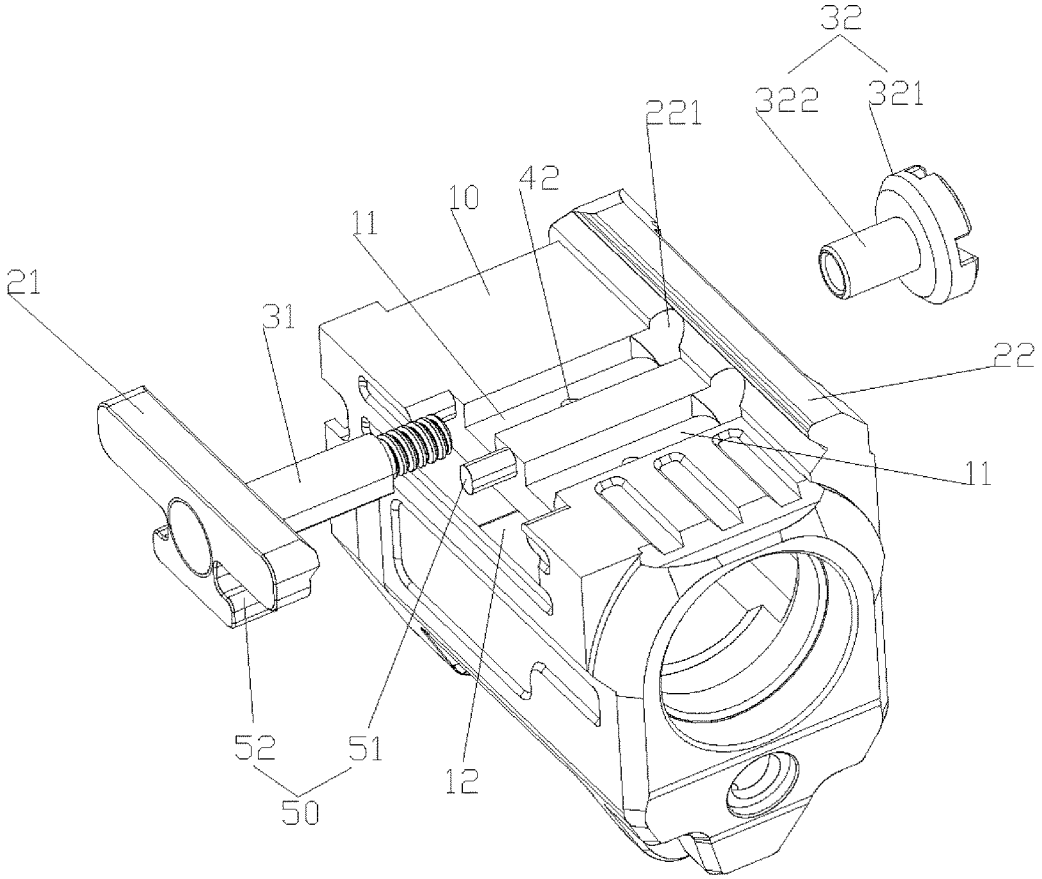
FIG. 1 shows an exploded view of a lamp according to an Embodiment 1 of the disclosure.

The abovementioned drawings may include the following reference numbers:

10: Housing; 11: Mounting channel; 12: Notch; 13: First limiting boss; 20: Guide rail clamp; 21: First sliding block; 211: Second limiting groove; 212: First screw hole; 22: Second sliding block; 221: Avoiding hole; 30: Connecting part; 31: Connecting piece; 311: Second limiting boss; 32: Locking piece; 321: First section; 322: Second section; 41: Positioning piece; 42: Positioning hole; 421: First positioning hole; 422: Second positioning hole; 423: Avoiding opening; 50: Limiting structure; 51: Limiting column; 52: First limiting groove; 60: Connection locking piece; 61: First external screw; 62: Screwing part.

DETAILED DESCRIPTION OF THE EMBODIMENTS

The technical solutions in the embodiments of the disclosure will be clearly and completely described below in combination with the drawings in the embodiments of the disclosure. It is apparent that the described embodiments are not all embodiments but part of embodiments of the disclosure. The description of at least one exemplary embodiment below, in fact, is illustrative only and will not be taken as any limitation of the disclosure and its disclosure or use. All other embodiments obtained by those of ordinary skill in the art on the basis of the embodiments in the disclosure without creative work shall fall within the scope of protection of the disclosure.

As shown in FIG. 1-FIG. 4, an Embodiment 1 of the disclosure provides a lamp. The lamp includes a housing 10, a guide rail clamp, a connecting component and a positioning structure, the guide rail clamp being arranged on the housing 10, the guide rail clamp including a first sliding block 21 and a second sliding block 22 that are arranged at intervals, the first sliding block 21 being detachably arranged on the housing 10, and the lamp being fixed on other device by making use of cooperation of the first sliding block 21 and the second sliding block 22. The connecting component is in connection with the first sliding block 21 to fix the first sliding block 21 on the housing 10, and the connecting component and the first sliding block 21 jointly form an assembling unit. In the embodiment, the positioning structure includes a positioning piece 41 and a positioning hole 42, the positioning piece 41 is arranged on one of the housing 10 and the assembling unit, the positioning hole 42 is arranged on another of the housing 10 and the assembling unit, and the positioning piece 41 is inserted into the positioning hole 42 when the assembling unit moves to an assembling position.

With adoption of the lamp provided by the embodiment, in a process of fixing the first sliding block 21 on the housing 10 by the connecting structure, in presence of cooperation of the positioning piece 41 and the positioning hole 42 of the positioning structure, the positioning piece 41 is inserted into the positioning hole 42 when the assembling unit moves to the assembling position, in this way the assembling unit is assembled and positioned, subsequent operations are facilitated, and accordingly an assembling process is simplified, and assembling is facilitated.

In the embodiment, the housing 10 has a mounting channel 11, the connecting component includes a connecting part 30, the connecting part 30 is moveably arranged in the mounting channel 11 in a penetrating manner, the connecting part 30 is in connection with the first sliding block 21, and the first sliding block 21 is fixed on the housing 10 by making use of the connecting part 30. The positioning piece 41 is arranged on one of a channel wall of the mounting channel 11 and the connecting part 30, and the positioning hole 42 is arranged on another of the channel wall of the mounting channel 11 and the connecting part 30.

The mounting channel 11 includes, but is not limited to, a mounting hole or a mounting groove. The mounting hole or the mounting groove is arranged on the housing 10, the connecting part 30 is moveably arranged in the mounting hole or the mounting groove in a penetrating manner, in this way the positioning structure is ensured not to be exposed, and integration of appearance of the lamp is improved. Moreover, the connecting part 30 is moveably arranged in the mounting hole or the mounting groove in the penetrating manner, in this way the connecting part 30 is avoided by making use of the mounting hole or the mounting groove, the connecting part 30 will not cause interference when the lamp is assembled onto other devices, and assembling is facilitated.

In the embodiment, the positioning piece 41 is made from an elastic material. When the connecting part 30 is inserted into the mounting channel 11, the positioning piece 41 may be extruded and deformed. When the connecting part 30 moves to the assembling position, the positioning piece 41 may return to a normal status and is inserted into the positioning hole 42, as to pre-tighten the connecting part 30 and the first sliding block 21. A material of the positioning piece 41 includes, but is not limited to, rubber.

Specifically, the connecting part 30 has an accommodating hole, an end of the positioning piece 41 is positioned inside the accommodating hole, and another end of the positioning piece 41 is arranged corresponding to the positioning hole 42. The positioning piece 41 may be fixed in the accommodating hole through interference fit, bonding and other methods.

To facilitate the positioning piece 41 entering into the positioning hole 42, or facilitate the positioning piece 41 escaping from the positioning hole 42, an end of the positioning piece 41 facing the positioning hole 42 is provided with a chamfer angle or an arc surface.

Figure 2:
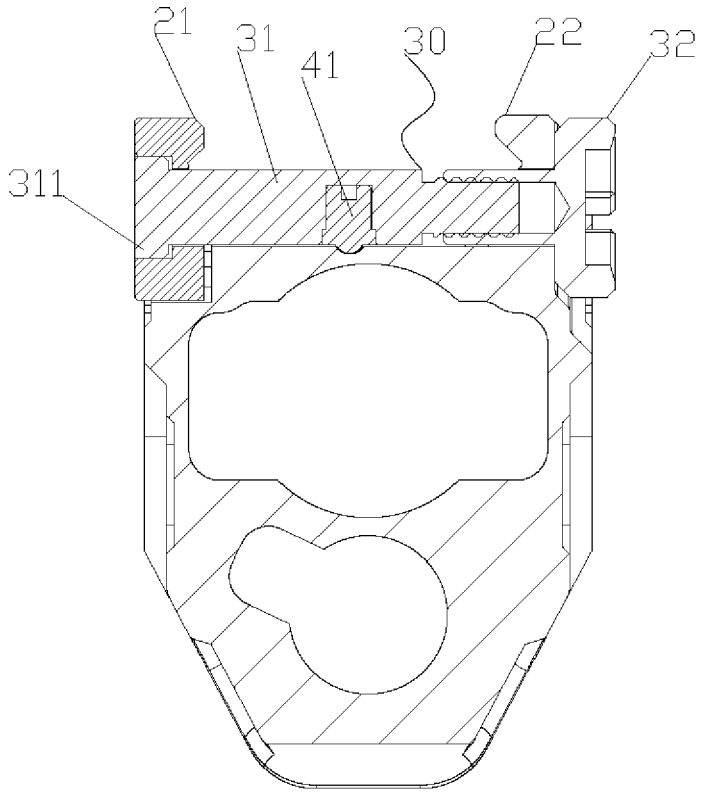
FIG. 2 shows a section view of a lamp according to an Embodiment 1 of the disclosure.

As shown in FIG. 1 and FIG. 2, in the embodiment, the connecting part 30 includes a connecting piece 31 and a locking piece 32, a first end of the connecting piece 31 is in connection with the first sliding block 21, the second sliding block 22 has an avoiding hole 221 that is arranged corresponding to the mounting channel 11, the locking piece 32 is positioned on a side, far away from the connecting piece 31, of the second sliding block 22, the locking piece 32 passes through the avoiding hole 221 and is in connection with a second end of the connecting piece 31, and the first sliding block 21 is fixed on the housing 10 by making use of the connecting part 30.

As shown in FIG. 2, the first end of the connecting piece 31 has a second limiting boss 311, the first sliding block 21 has a stepped hole, the first end of the connecting piece 31 is arranged in the stepped hole in a penetrating manner, the second limiting boss 311 fits a step plane formed by the stepped hole in a limiting manner, in this way the connecting piece 31 is prevented from escaping from the stepped hole, and accordingly connection of the connecting piece 31 and the first sliding block 21 is realized.

Specifically, the first end of the connecting piece 31 is fixed in the stepped hole through interference fit, welding, bonding and other methods, as to further improve connection firmness of the connecting piece 31 and the first sliding block 21.

As shown in FIG. 1 and FIG. 2, the second sliding block 22 is fixed on the housing 10, the locking piece 32 includes a first section 321 and a second section 322 connected with the first section 321. The first section 321 is positioned on the side, far away from the connecting piece 31, of the second sliding block 22, an outer diameter of the first section 321 is greater than an outer diameter of the second section 322 and a diameter of the avoiding hole 221, and the second section 322 passes through the avoiding hole 221 and is in connection with the second end of the connecting piece 31 through a screw, in this way the connection of the locking piece 32 and the connecting piece 31 is finished, and accordingly the first sliding block 21 may be fixed on the housing 10 by the connection of the connection piece 31 and the locking piece 32. Moreover, the locking piece 32 is in connection with the connecting piece 31 through the screw, with simple structure and convenient assembling. In this way, assembling efficiency is improved.

In the embodiment, the second end of the connecting piece 31 has second external screw, the second section 322 of the locking piece 32 has a second screw hole fitting the second screw, and the second end of the connecting piece 31 is arranged in the second screw hole of the locking piece 32 in a penetrating manner. The locking piece 32 is provided with lubricating silicone grease, thereby ensuring that the locking piece 32 is screwed on the connecting piece 31 successfully.

Figure 3:
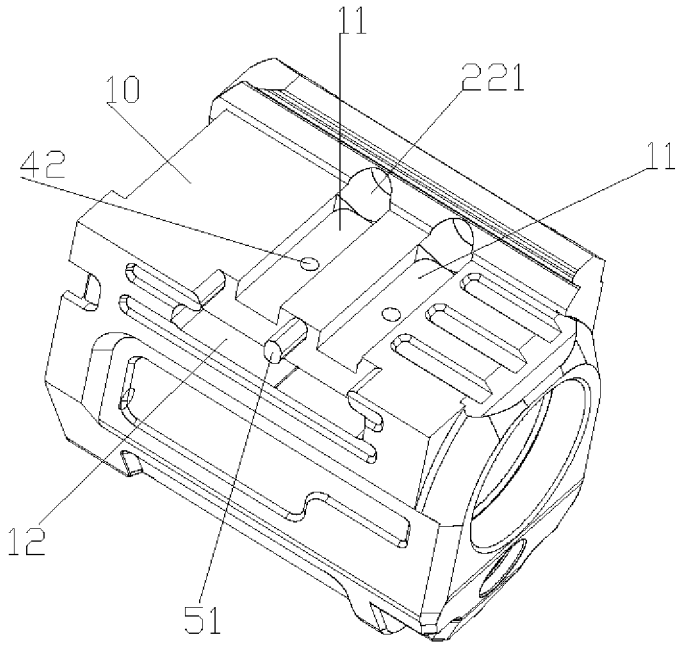
FIG. 3 shows a structure diagram of a housing in FIG. 1.

As shown in FIG. 1 and FIG. 3, the mounting channel 11 is a mounting groove, the positioning hole 42 is arranged at a bottom of the mounting groove, and the positioning piece 41 is arranged on a side wall of the connecting part 30. In the embodiment, a side wall of the connecting piece 31 is provided with an accommodating hole, and the positioning piece 41 is fixed on the connecting piece 31 through the accommodating hole.

In other embodiments, the bottom of the mounting groove may be provided with the positioning piece 41, and the side wall of the connecting piece 31 may be provided with the positioning hole 42, in this way the connecting part 30 and the first sliding block 21 may be pre-tightened as well by making use of the cooperation of the positioning piece 41 the positioning hole 42.

As shown in FIG. 1, the lamp further includes a limiting structure 50, the limiting structure 50 including a limiting column 51 and a first limiting groove 52, the limiting column 51 being arranged on one of the housing 10 and the first sliding block 21, and the first limiting groove 52 being arranged on another of the housing 10 and the first sliding block 21. An extension direction of the first limiting groove 52 is the same as an extension direction of the mounting channel 11. When the connecting part 30 is inserted into the mounting channel 11, the limiting column 51 may be synchronously inserted into the first limiting groove 52. By making use of the cooperation of the limiting column 51 and the first limiting groove 52, the connecting part 30 can be radially limited, thereby preventing the connecting part 30 from swinging relative to the mounting channel 11. When the connecting part 30 moves to the assembling position, the positioning piece 41 is inserted into the positioning hole 42 successfully.

In the embodiment, the limiting column 51 is arranged on the housing 10, and the first limiting groove 52 is arranged on the first sliding block 21. In other embodiments, the limiting column 51 may be arranged on the first sliding block 21, and the first limiting groove 52 is arranged on the housing 10.

The housing 10 has multiple mounting channels 11 that are arranged at intervals, the connecting part 30 may be selectively inserted into corresponding mounting channel 11 according to a use requirement, in this way the lamp satisfies various use requirements. Specifically, the mounting channel 11 extends along a width direction of the housing 10, and both the first sliding block 21 and the second sliding block 22 extend along a length direction of the housing 10.

Figure 4:
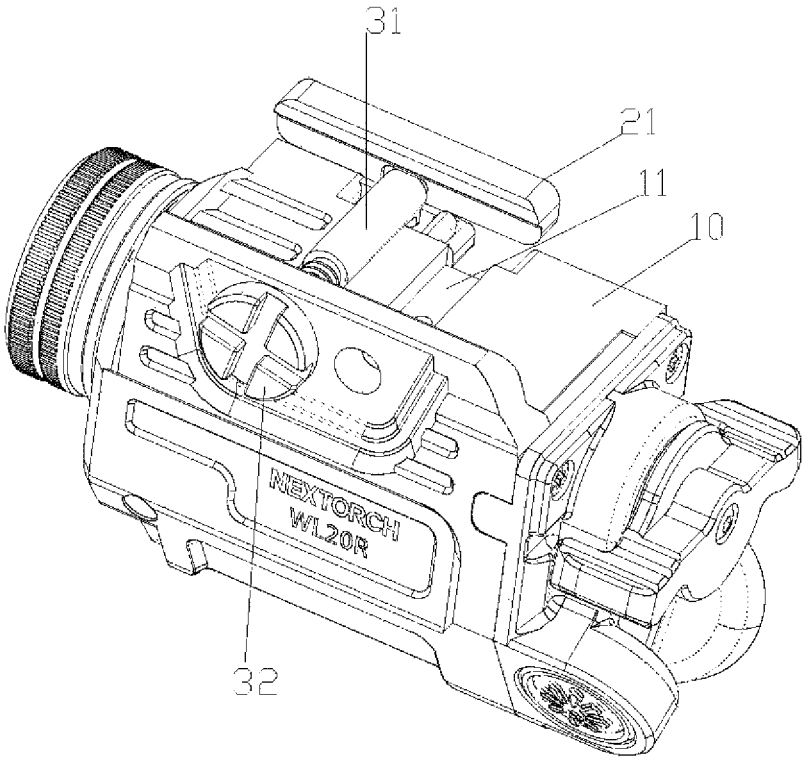
FIG. 4 shows a structure diagram of a lamp according to an Embodiment 1 of the disclosure.

As shown in FIG. 1, FIG. 3 and FIG. 4, the housing 10 has two mounting channels 11 that are arranged at intervals, the limiting column 51 is arranged on the housing 10 and positioned between the two mounting channels 11, and two sides of the first sliding block 21 are symmetrically provided with two first limiting grooves 52. With the adoption of the abovementioned structure, the limiting column 51 may be ensured to be inserted into the corresponding first limiting groove 52 no matter which mounting channel 11 the connecting part 30 is positioned, and accordingly the connecting part 30 is radially limited by making use of the limiting column 51 and the first limiting groove 52. Specifically, the first sliding block 21 is an I-shaped structure, and the two first limiting grooves 52 are symmetrically arranged on the two sides of the first sliding block 21.

In the embodiment, the lamp may be adaptable to a Picatinny guide rail and a Glock guide rail.

In the embodiment, the housing 10 has a notch 12, and the first sliding block 21 is arranged in the notch 12. By making use of the notch 12, the first sliding block 21 may be avoided, and the first sliding block 21 may be limited.

Moreover, on the premise that the housing 10 is provided with the multiple mounting channels 11, the notch 12 may be arranged as multiple stepped structures having different sizes, in this way the guide rail clamp has multiple widths and depths when the connecting part 30 is arranged in the different mounting channels 11 in the penetrating manner. For example, there are two mounting channels 11 with different depths, the notch 12 is arranged as a two-layer structure in a width direction of the housing 10. A width between the first sliding block 21 and the second sliding block 22 is a first width when the first sliding block 21 is positioned at a first layer of the notch 12, and a width between the first sliding block 21 and the second sliding block 22 is a second width when the first sliding block 21 is positioned at a second layer of the notch 12. The first width is greater than or less than the second width.

In the embodiment, the lamp may include a gun lamp.

Through the lamp provided by the embodiment, the lamp may be adaptable to a variety of different guide rails, lights may achieve a best position, and rapid assembling, clamping and disassembling may be achieved.

Figure 5:
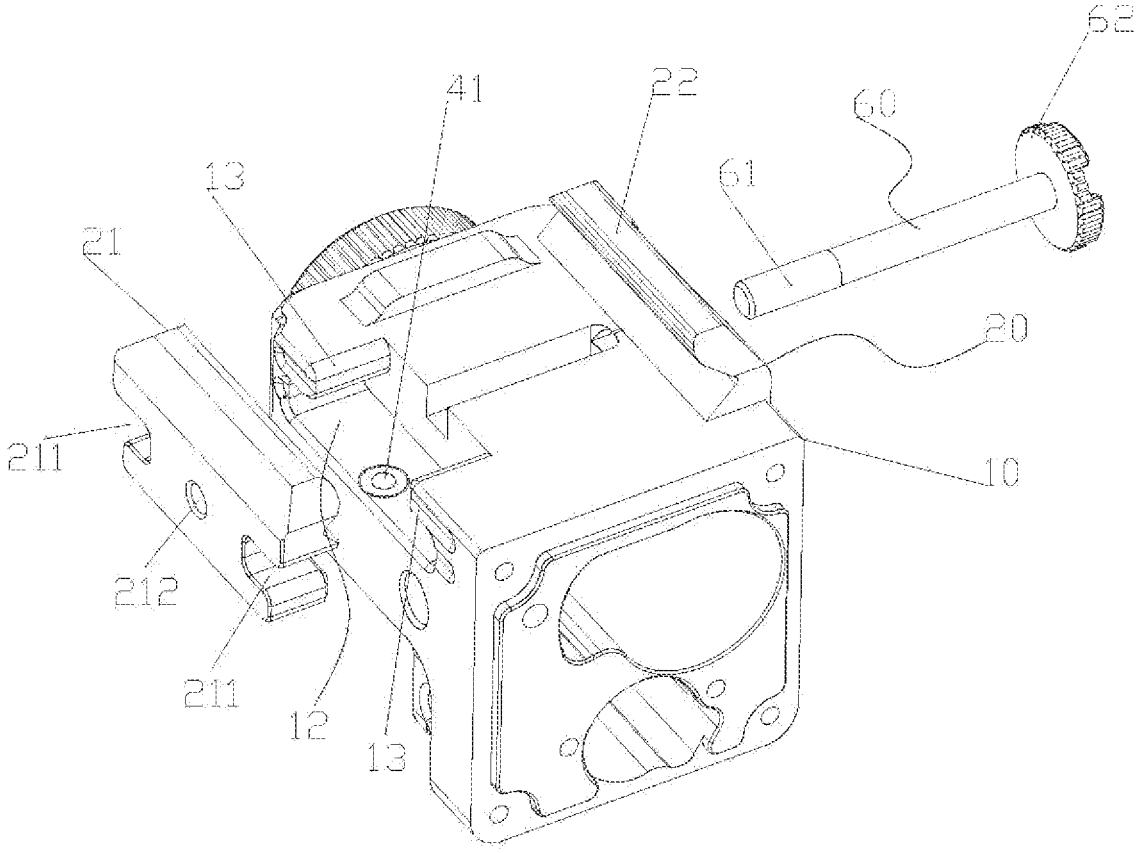
FIG. 5 shows a structure diagram of a lamp according to an Embodiment 2 of the disclosure.
Figure 6:
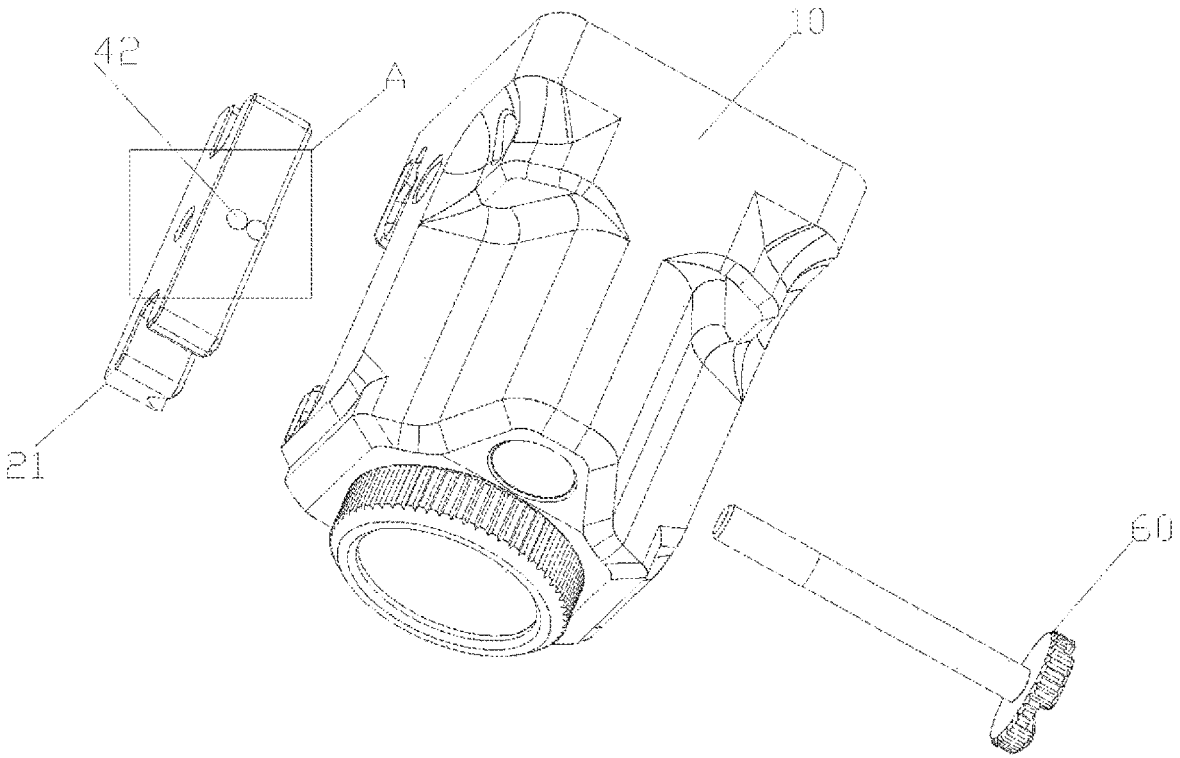
FIG. 6 shows a structure diagram of a lamp according to an Embodiment 2 of the disclosure from another vision angle.
Figure 7:
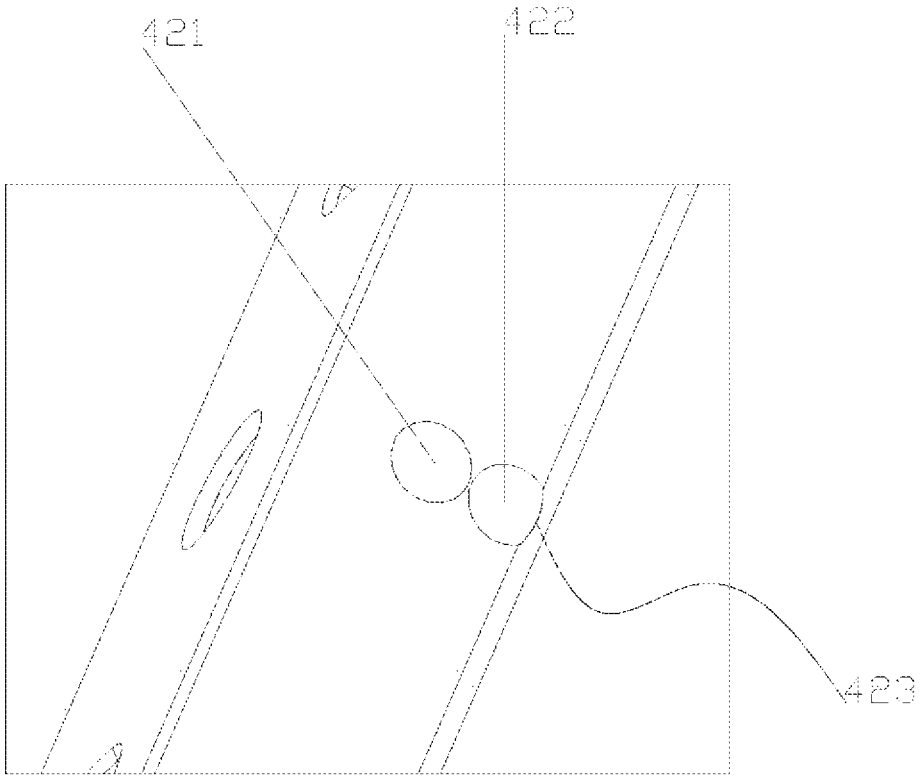
FIG. 7 shows an enlarged view of a position A in FIG. 6.

As shown in FIG. 5-FIG. 7, an Embodiment 2 of the disclosure provides a lamp. The lamp includes a housing 10, a guide rail clamp 20, a connecting component and a positioning structure, the guide rail clamp 20 being arranged on the housing 10, and the guide rail clamp 20 including a first sliding block 21 and a second sliding block 22 that are arranged at intervals. The connecting component is in connection with the first sliding block 21 to fix the first sliding block 21 on the housing 10, and the connecting component and the first sliding block 21 jointly form an assembling unit. The positioning structure includes a positioning piece 41 and a positioning hole 42.

A difference between the Embodiment 2 and Embodiment 1 is that the positioning piece 41, in the Embodiment 2, is arranged on one of the housing 10 and the first sliding block 21, the positioning hole 42 is arranged on another of the housing 10 and the first sliding block 21, the connecting component includes a connection locking piece 60, the connection locking piece 60 is in connection with the first sliding block 21, as to lock the first sliding block 21 on the housing 10.

Specifically, in the Embodiment 2, the positioning piece 41 is arranged on the housing 10, and the positioning hole 42 is arranged on the first sliding block 21. When the first sliding block 21 is positioned at an assembling position, the positioning piece 41 is inserted into the positioning hole 42, as to pre-tighten and position the first sliding block 21. After the first sliding block 21 is pre-tightened and positioned, the connection locking piece 60 is in connection with the first sliding block 21, so as to lock the first sliding block 21 on the housing 10.

With the adoption of the lamp provided by the embodiment, in a process of assembling the first sliding block 21 onto the housing 10, the first sliding block 21 is pre-tightened and positioned by making use of the cooperation of the positioning piece 41 and the positioning hole 42, then the connection locking piece 60 is in connection with the first sliding block 21, so as to lock the first sliding block 21 on the housing 10, and assembling of the lamp and a gun is finished. The positioning piece 41 fits the positioning hole 42 to form the positioning structure, with simple structure and convenient assembling. Accordingly, assembling efficiency may be improved.

In other embodiments, the positioning piece 41 may be arranged on the first sliding block 21, and the positioning hole 42 is arranged on the housing 10.

As shown in FIG. 5, the housing 10 has a limiting boss, and the limiting boss in the embodiment is a first limiting boss 13 specifically. Aside wall of the first sliding block 21 is provided with a second limiting groove 211, and an extension direction of the second limiting groove 211 is parallel to an assembling direction of the first sliding block 21. In the process of assembling the first sliding block 21 onto the housing 10, the first limiting boss 13 fits the second limiting groove 211 in a limiting manner, thereby ensuring that the first sliding block 21 is assembled only along a predetermined direction. Moreover, when the first sliding block 21 is positioned at the assembling position, degree of freedom of the first sliding block 21 may be limited by making use of the cooperation of the first limiting boss 13 and the second limiting groove 211, thereby ensuring that the first sliding block 21 is in a pre-tightened and positioned status.

As shown in FIG. 5, a side wall of the housing 10 is provided with a notch 12, the notch 12 has a side opening and a top opening, the first limiting boss 13 is positioned at the top opening of the notch 12, and a lower part of the first sliding block 21 is positioned inside the notch 12. The lower part of the first sliding block 21 is accommodated by making use of the notch 12, thereby facilitating decreasing of a volume of the lamp and achieving miniaturization of the lamp.

In the embodiment, under a condition that the first sliding block 21 is assembled to the housing 10, an outer wall of the first sliding block 21 is aligned with an outer wall of the housing 10, thereby ensuring integration of the lamp.

In the embodiment, the positioning piece 41 is positioned on a bottom wall of the notch 12. Under the condition that the first sliding block 21 is assembled to the housing 10, the positioning piece 41 and the positioning hole 42 will not be exposed, thereby ensuring the integration of the lamp.

In other embodiments, the positioning hole 42 may be arranged on the bottom wall of the notch.

As shown in FIG. 5, each of two sides of the top opening of the notch 12 is provided with one first limiting boss 13, each of two sides of the first sliding block 21 is provided with one second limiting groove 211, and two first limiting bosses 13 correspond to two second limiting grooves 211 one by one. Limitation is implemented by making use of the cooperation of the two first limiting bosses 13 and the two second limiting grooves 211, on one hand, limitation effect may be improved, on the other hand, movement stability of the first sliding block 21 is improved through the cooperation of the two first limiting bosses 13 and the two second limiting grooves 211 in a process that the first sliding block 21 moves relative to the housing 10.

Specifically, the first sliding block 21 is an I-shaped sliding block, by which the limitation effect is ensured and it is convenient to process.

As shown in FIG. 6 and FIG. 7, the positioning hole 42 includes a first positioning hole 421 and a second positioning hole 422, and the first positioning hole 421 and the second positioning hole 422 are arranged at intervals along the assembling direction of the first sliding block 21. When the first sliding block 21 is positioned at the assembling position, the positioning piece 41 is inserted into the first positioning hole 421, and a side, far away from the first positioning hole 421, of the second positioning hole 422 has an avoiding opening 423.

In the process of assembling the first sliding block 21 onto the housing 10, the positioning piece 41 is avoided by making use of the avoiding opening 423. The first sliding block 21 moves into the second positioning hole 422 first, in this way the first sliding block 21 continues to move, and the first sliding block 21 will move into the first positioning hole 421 from the second positioning hole 422. Through arrangement of the two positioning holes, a user is reminded by making use of cooperation of the two positioning holes and the positioning piece 41, thereby facilitating the user to judge a current position of the first sliding block 21.

As shown in FIG. 5, the first sliding block 21 has a screw hole, and the screw hole in the embodiment is a first screw hole 212 specifically. A first end of the connection locking piece 60 has an external screw, and the external screw in the embodiment is a first external screw 61 specifically. A second end of the connection locking piece 60 has a screwing part 62, the second sliding block 22 has a through hole, the screwing part 62 is positioned on a side, far away from the first sliding block 21, of the second sliding block 22, an outer diameter of the screwing part 62 is greater than a diameter of the through hole, and the first end of the connection locking piece 60 passes through the through hole and is in connection with the first screw hole 212. When the first sliding block 21 is positioned at the assembling position, the first end of the connection locking piece 60 passes through the through hole and is in connection with the first screw hole 212, so that the first sliding block 21 is fixed on the housing 10, and the assembling is finished.

As shown in FIG. 5, an outer wall of the positioning piece 41 has a curved surface. Through arranging the curved surface on the positioning piece 41, the curved surface may play a role of guiding the assembling, and the positioning piece 41 is facilitated to move into the positioning hole 42.

In the embodiment, a top wall of the positioning piece 41 is a curved surface.

In the embodiment, the positioning piece 41 is made from an elastic material. When the positioning piece 41 is in contact with the first sliding block 21, the positioning piece 41 may be extruded and deformed. When the first sliding block 21 moves to the assembling position, the positioning piece 41 may return to a normal status and is inserted into the positioning hole 42, so as to pre-tighten the first sliding block 21. A material of the positioning piece 41 may include, but is not limited to, rubber.

In the embodiment, the lamp is a gun lamp. The lamp may be adaptable to a Picatinny guide rail and a Glock guide rail.

With the adoption of the device provided by the embodiment, in the process of fixing the first sliding block 21 on the housing 10, by making use of the cooperation of the positioning piece 41 and the positioning hole 42 of the positioning structure, the positioning piece 41 may be inserted into the positioning hole 42 when the first sliding block 21 moves to the assembling position, in this way the first sliding block 21 is assembled and positioned, subsequent operations are facilitated, and accordingly the assembling process may be simplified, and the assembling is facilitated.

It should be noted that terms used herein are merely intended to describe specific embodiments rather than limit exemplary embodiments according to the disclosure. Unless otherwise pointed out explicitly, a singular form used herein is also intended to include a plural form. In addition, it should also be understood that the term "include" and/or "comprise" used in the description indicates that there are features, steps, operations, devices, assemblies and/or combinations thereof.

The above are only preferred embodiments of the disclosure and are not intended to limit the disclosure. Those skilled in the art may make various modifications and variations. Any modifications, equivalent replacements, improvements and the like made within the spirit and principle of the disclosure shall fall within the scope of protection of the disclosure.

What is claimed is:

1. A lamp, comprising:

a housing;

a guide rail clamp, arranged on the housing, the guide rail clamp comprising a first sliding block and a second sliding block that are arranged at intervals, and the first sliding block being detachably arranged on the housing;

a connecting component, the connecting component being in connection with the first sliding block to fix the first sliding block on the housing, and the connecting component and the first sliding block jointly forming an assembling unit; and a positioning structure, comprising a positioning piece and a positioning hole, the positioning piece being arranged on one of the housing and the assembling unit, the positioning hole being arranged on another of the housing and the assembling unit, and the positioning piece being inserted into the positioning hole when the assembling unit moves to an assembling position.

2. The lamp as claimed in claim 1, wherein, the housing is provided with a mounting channel, the connecting component comprises a connecting part, the connecting part is moveably penetrated in the mounting channel, the positioning piece is arranged on one of a channel wall of the mounting channel and the connecting part, and the positioning hole is arranged on another of the channel wall of the mounting channel and the connecting part.

3. The lamp as claimed in claim 1, wherein, the positioning piece is made from an elastic material.

4. The lamp as claimed in claim 2, wherein, the connecting part is provided with an accommodating hole, an end of the positioning piece is positioned inside the accommodating hole, and another end of the positioning piece is arranged corresponding to the positioning hole.

5. The lamp as claimed in claim 2, wherein, the connecting part comprises a connecting piece and a locking piece, a first end of the connecting piece is in connection with the first sliding block, the second sliding block is provided with an avoiding hole that is arranged corresponding to the mounting channel, the locking piece is positioned on a side, far away from the connecting piece, of the second sliding block, and the locking piece passes through the avoiding hole and is in connection with a second end of the connecting piece.

6. The lamp as claimed in claim 5, wherein, the locking piece comprises a first section and a second section connected with the first section, the first section is positioned on the side, far away from the connecting piece, of the second sliding block, an outer diameter of the first section is greater than an outer diameter of the second section and a diameter of the avoiding hole, and the second section passes through the avoiding hole and is in connection with the second end of the connecting piece by a screw.

7. The lamp as claimed in claim 2, wherein, the mounting channel is a mounting groove, the positioning hole is arranged at a bottom of the mounting groove, and the positioning piece is arranged on a side wall of the connecting part.

8. The lamp as claimed in claim 2, wherein, the lamp further comprises a limiting structure, the limiting structure comprising a limiting column and a first limiting groove, the limiting column being arranged on one of the housing and the first sliding block, the first limiting groove being arranged on another of the housing and the first sliding block, the limiting column being moveably inserted into the first limiting groove, and an extension direction of the first limiting groove is the same as an extension direction of the mounting channel.

9. The lamp as claimed in claim 8, wherein, the housing is provided with two mounting channels that are arranged at intervals, the limiting column is arranged on the housing and positioned between the two mounting channels, and two sides of the first sliding block are symmetrically provided with two first limiting grooves.

10. The lamp as claimed in claim 2, wherein, the housing is provided with a plurality of mounting channels that are arranged at intervals; and/or, the mounting channel extends along a width direction of the housing, and both the first sliding block and the second sliding block extend along a length direction of the housing.

11. The lamp as claimed in claim 1, wherein, the housing is provided with a notch, and the first sliding block is arranged in the notch.

12. The lamp as claimed in claim 1, wherein, the positioning piece is arranged on one of the housing and the first sliding block, the positioning hole is arranged on another of the housing and the first sliding block, the connecting component comprises a connection locking piece, and the connection locking piece is in connection with the first sliding block, so as to lock the first sliding block on the housing.

13. The lamp as claimed in claim 12, wherein, the housing is provided with a limiting boss, a side wall of the first sliding block is provided with a second limiting groove, an extension direction of the second limiting groove is parallel to an assembling direction of the first sliding block, and the limiting boss limits the second limiting groove in a limiting manner.

14. The lamp as claimed in claim 13, wherein, a side wall of the housing is provided with a notch, the notch is provided with a side opening and a top opening, the limiting boss is positioned at the top opening of the notch, and a lower part of the first sliding block is positioned inside the notch.

15. The lamp as claimed in claim 14, wherein, the positioning piece or the positioning hole is positioned on a bottom wall of the notch.

16. The lamp as claimed in claim 14, wherein, each of two sides of the top opening of the notch is provided with one limiting boss, each of two sides of the first sliding block is provided with one second limiting groove, and two limiting bosses correspond to two second limiting grooves one by one.

17. The lamp as claimed in claim 12, wherein, the positioning hole comprises a first positioning hole and a second positioning hole, and the first positioning hole and the second positioning hole are arranged at intervals along the assembling direction of the first sliding block.

18. The lamp as claimed in claim 17, wherein, when the first sliding block is positioned at the assembling position, the positioning piece is inserted into the first positioning hole, and a side, far away from the first positioning hole, of the second positioning hole is provided with an avoiding opening.

19. The lamp as claimed in claim 12, wherein, the first sliding block is provided with a screw hole, a first end of the connection locking piece is provided with an external screw, a second end of the connection locking piece is provided with a screwing part, the second sliding block is provided with a through hole, the screwing part is positioned on a side, far away from the first sliding block, of the second sliding block, an outer diameter of the screwing part is greater than a diameter of the through hole, and a first end of the connection locking piece passes through the through hole and is in connection with the screw hole.

20. The lamp as claimed in claim 12, wherein, an outer wall of the positioning piece is provided with a curved surface.

* * * * *